US007637781B2

(12) United States Patent
Matsumoto et al.

(10) Patent No.: US 7,637,781 B2
(45) Date of Patent: Dec. 29, 2009

(54) FUSIBLE LINK UNIT WITH HINGE SECTION

(75) Inventors: Yusuke Matsumoto, Shizuoka-ken (JP); Norihiro Ohashi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/260,691

(22) Filed: Oct. 29, 2008

(65) Prior Publication Data

US 2009/0111316 A1 Apr. 30, 2009

(30) Foreign Application Priority Data

Oct. 30, 2007 (JP) ..... P2007-281939

(51) Int. Cl.
*H01R 13/68* (2006.01)

(52) U.S. Cl. ..... 439/620.27; 337/159; 337/160

(58) Field of Classification Search ..... 439/620.26–27; 337/159, 160

See application file for complete search history.

(56) References Cited

U.S. PATENT DOCUMENTS 6,806,421 B2 * 10/2004 Matsumura ..... 174/50
6,830,482 B2 * 12/2004 Matsumura et al. .... 439/620.27
7,420,453 B2 * 9/2008 Matsumura et al. ..... 337/295
2001/0011939 A1 * 8/2001 Inaba et al. ..... 337/265
2008/0030295 A1 * 2/2008 Matsumoto et al. ..... 337/290
2009/0061291 A1 * 3/2009 Ohashi et al. ..... 429/65

FOREIGN PATENT DOCUMENTS

JP 2001-297683 10/2001
JP 2004-186006 7/2004

* cited by examiner

*Primary Examiner*—Renee Luebke
*Assistant Examiner*—Larisa Tsukerman
(74) *Attorney, Agent, or Firm*—Finnegan, Henderson, Farabow, Garrett & Dunner, L.L.P.

(57) ABSTRACT

A hinge section including bending sections at both side edges of a band plate section is provided in center of a busbar. On both sides of the hinge section, two fuse circuit constituting plate sections are integrally formed to be linked thereto. Two resin housings are assembled by insert molding to the respective fuse circuit constituting plate sections, thus forming two bodies. The two bodies are pivoted in the same direction at the bending sections, and engagement units are locked, thus constituting a fusible link unit having a U-shaped plan view. The two bodies are engaged with each other in vicinity areas of the hinge section in the opposed surfaces of the opposed resin housing when the two bodies are pivoted. The fusible link unit also includes recessed and projected guides guiding the two resin housings to proper positions.

5 Claims, 10 Drawing Sheets

FUSIBLE LINK UNIT WITH HINGE SECTION

BACKGROUND OF THE INVENTION

1. Field of the Invention

The present invention relates to a fusible link unit which is directly mounted on a battery of a vehicle and supplies power through a plurality of fuses (a fusible section) to each load. Specifically, the present invention relates to a fusible link unit which is fabricated in a flat shape by performing insert-molding of resin housings with a busbar being attached to a mold, the busbar including a fuse circuit constituting section, and is then bent according to a form of attachment to the battery or the like into a stereoscopic block shape.

2. Description of the Related Art

As such a type of fusible link units, fusible link units described in Patent Publications 1 and 2 are known.

The fusible link unit described in Patent Publication 1 includes a bendable hinge section 533 in the center of a busbar 530 as shown in FIG. 1. Fuse circuit constituting plate sections (not shown) are provided on both sides of the hinge section 533 to be linked thereto. On the both fuse circuit constituting plate sections, resin housings 511 and 521 are molded with necessary part being exposed to the outside, thus forming two bodies 510 and 520 constituting fusible links. After the molding, the two bodies 510 and 520 are pivoted at the hinge section 533 at about 90° into an L-shaped position. Reference numeral 536 in the drawing denotes a fusible section.

The fusible link unit described in Patent Publication 2 includes a hinge section in the center of a busbar, the hinge section including bending sections at both side edges of a band plate section. On both sides of the hinge section, two fuse circuit constituting plate sections are integrally formed to be linked thereto. These two fuse circuit constituting plate sections are arranged in parallel at a distance equal to width of the band plate interposed therebetween when being pivoted at the bending sections in a same direction. Two resin housings composed of insulating resin are assembled by insert molding to the individual fuse circuit constituting plate sections with necessary part being exposed, thus forming two bodies constituting fusible links. The two bodies are then pivoted at the bending sections in the same direction. The two bodies and hinge section form a U shape in a plan view. The two resin housings are locked by engagement units in the form of U.

Patent Publication 1: Japanese Patent Laid-open Publication No. 2001-297683

Patent Publication 2: Japanese Patent Laid-open Publication No. 2004-186006

SUMMARY OF THE INVENTION

In each of the aforementioned conventional fusible link units, the positional relationship between the two bodies is determined by pivoting the two bodies at the hinge section formed on the busbar. Accordingly, the positional relationship between the two bodies can significantly vary depending on the bending manner at the hinge section. Because of the variations in positional relationship between the two bodies, the unit cannot be connected to the other connector for wire length of the other connector is insufficient, unnecessary stress applied to the connecting section may cause deformation of the unit, or degradation in water proof or wire detachment of the other connector may be caused.

In the aforementioned conventional fusible link unit, the positional relationship between the two bodies depends on the hinge section. Accordingly, overall strength of the fusible link unit may depend on strength of the hinge section. When the fusible link unit mounted on a vehicle is exposed to vibration, stress and fatigue are concentrated on the hinge section, and the hinge section is subject to damage. Moreover, upon external force being applied thereto, large stress is concentrated on the hinge section. Accordingly, the plate thickness of the busbar itself therefore needs to be thick, and the fusible link unit therefore cannot be applied to a low current fuse.

In the light of the aforementioned circumstances, an object of the present invention is to provide a fusible link unit in which the positional relation between the two bodies can be properly maintained; engagement units locking the bodies can be easily engaged with each other, and stress concentrated on the hinge section is reduced for an increase in overall strength.

A fusible link unit according to a first aspect of the present invention includes: a busbar; a hinge section provided in center of the busbar and includes bending sections at both side edges of a band plate section; and two bodies constituting fusible links, which are integrally provided on both sides of the hinge section to be linked to two fuse circuit constituting plate sections and formed by assembling two resin housings composed of insulating resin by insert molding to the respective fuse circuit constituting plate sections with necessary part being exposed, the two bodies being arranged in parallel at a distance equal to width of the band plate after being pivoted at the bending sections in a same direction. The two bodies are pivoted in the same direction at the bending sections into a U shape in a plan view, and the U shape in the plan view is maintained by engagement units which are individually provided for the resin housings at positions distant from the hinge section. Moreover, at least a pair of recessed and projected guides is provided in vicinity of the hinge section in opposed surfaces of the two resin housings, the recessed and projected guides are opposed to each other when the two bodies are pivoted and are engaged with each other when the two bodies are pivoted to guide the two resin housings to proper positions.

In the fusible link unit according to the first aspect of the present invention, the plurality of pairs of recessed and projected guides may be provided, the pairs of recessed and projected guides are arranged along both side edges of the band plate section at intervals.

Moreover, the recessed and projected guides may respectively include an inner bottom surface and a top surface which abut on each other when the two bodies are completely pivoted. At this time, the fusible link unit may include engagement units locking the two bodies. Herein, the engagement units are not engaged and distant from each other when the inner bottom surface of the recessed guide and the top surface of the projected guide abut on each other and are engaged with each other when the bodies are bent.

Furthermore, the fusible link unit may include: a guiding slope in at least one of an inner side surface of the recessed guide or an outer side surface of the projected guide. Herein, the guiding slope is brought into sliding contact with the recessed or projected guide when the recessed and projected guides start to be engaged with each other and then guides the same to a proper position.

According to the fusible link unit of the first aspect of the present invention, the recessed and projected guides are provided near the hinge section. During the process of causing the two bodies to face each other, the two bodies are locked with the positions thereof being restricted by the guiding operation of the recessed and projected guides. Accordingly, the two bodies are set at proper positions when the bending is completed without any special awareness of an operator. The engagement units of the two bodies are reliably engaged with each other. This eliminates variations in positional relationship between the two bodies, and, for example, the fusible link unit can be easily fit to the other connector. This eliminates possibilities of disconnection of the connector due to insufficient wire length of the connector, deformation of the unit due to unnecessary stress applied to the connecting sections, or degradation of water proof or detachment of wires of the other connector. Moreover, a part of external force is received by the part near the hinge section where the recessed and projected guides are engaged. This reduces the stress concentration on the hinge section. Accordingly, the possibility of damage to the hinge section is considerably reduced when external force including vibration acts on the fusible link unit. The whole strength of the fusible link unit is thus increased, and product strength is less affected by the hinge section. The busbar itself therefore can be made thin so that the fusible link unit is available for low current fuses.

Moreover, the several pairs of recessed and projected guides are provided along the bending sections. In this case, the bodies are therefore guided into a predetermined positional relationship as the bending proceeds even if the degree of bending is different between the top and bottom of each bending sections. The two bodies are therefore locked at proper positions.

The distance between the two bodies can be properly set by the inner bottom surface of the recessed guide and top surface of the projected guide abutting on each other. The band plate section of the hinge section is not deformed unnecessarily. Moreover, the engagement units provided for the two bodies are therefore engaged with each other by causing the inner bottom surface of the recessed guide and the top surface of the projected guide to abut on each other and then further bending the bodies. Accordingly, it is possible to obtain an engagement without rattling using elasticity of the bodies. This can improve the resistance to vibration of the fusible link unit mounted on a battery and prevent abnormal noise of the same. Moreover, dimensional fitting tolerance of the engaging units does not need to be strictly set, thus reducing manufacturing cost of a mold. Moreover, the pairs of recessed and projected guides are arranged along the bending sections in the vertical direction. The interval between the two bodies is properly controlled at each vertical position of the recessed and projected guides. This increases workability at engaging the engagement units. Furthermore, when the engagement units are engaged with each other, the place where the recessed and projected guides abut on each other serves as a fulcrum, and tension is applied to the hinge section. This prevents deformation of the band plate section.

Even if the bending angles at the bending sections vary between the top and bottom of the two bodies, the bending positions are corrected by the guiding slopes of the recessed and projected guides brought into sliding contact with each other. The bodies can be therefore eventually guided to the proper positions, and the engagement units of the two bodies can be appropriately aligned. The two bodies are then properly locked.

DESCRIPTION OF THE PREFERRED EMBODIMENT

Figure 1A:
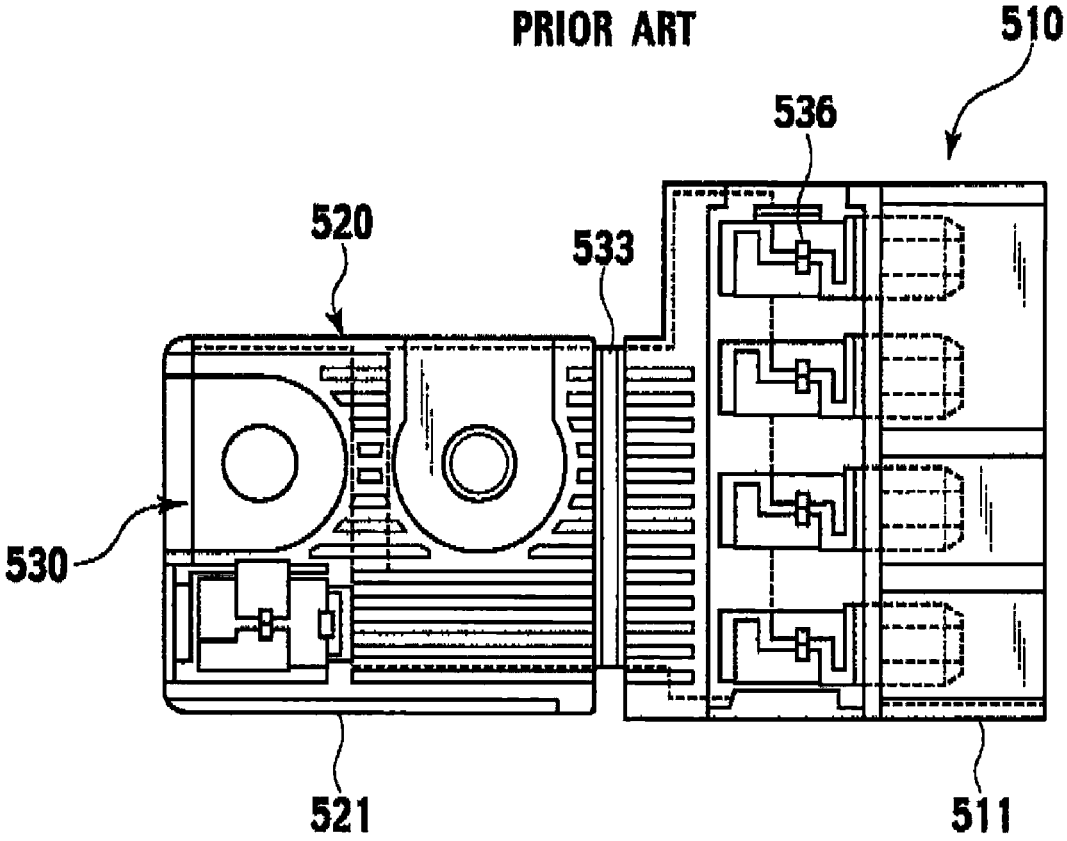
FIG. 1A PRIOR ART
FIGS. 1A and 1B are front and plan views of a conventional example, respectively.
Figure 1B:
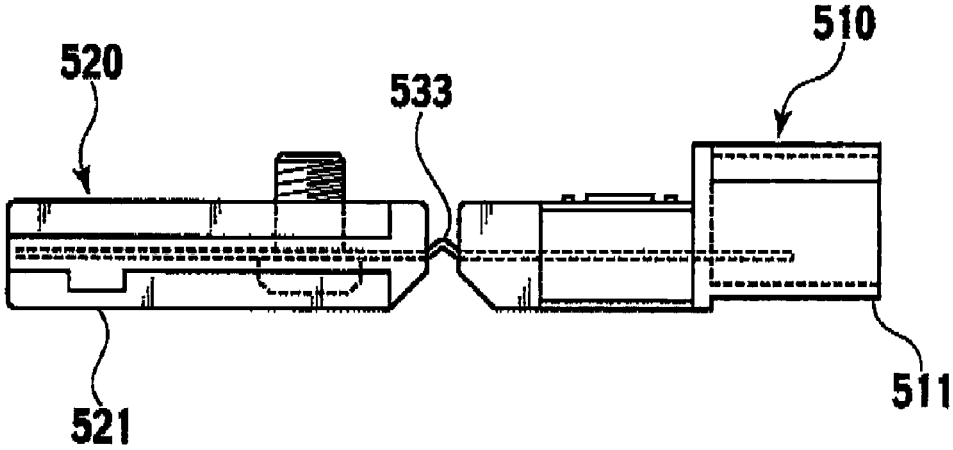
FIG. 1B PRIOR ART
Figure 2:
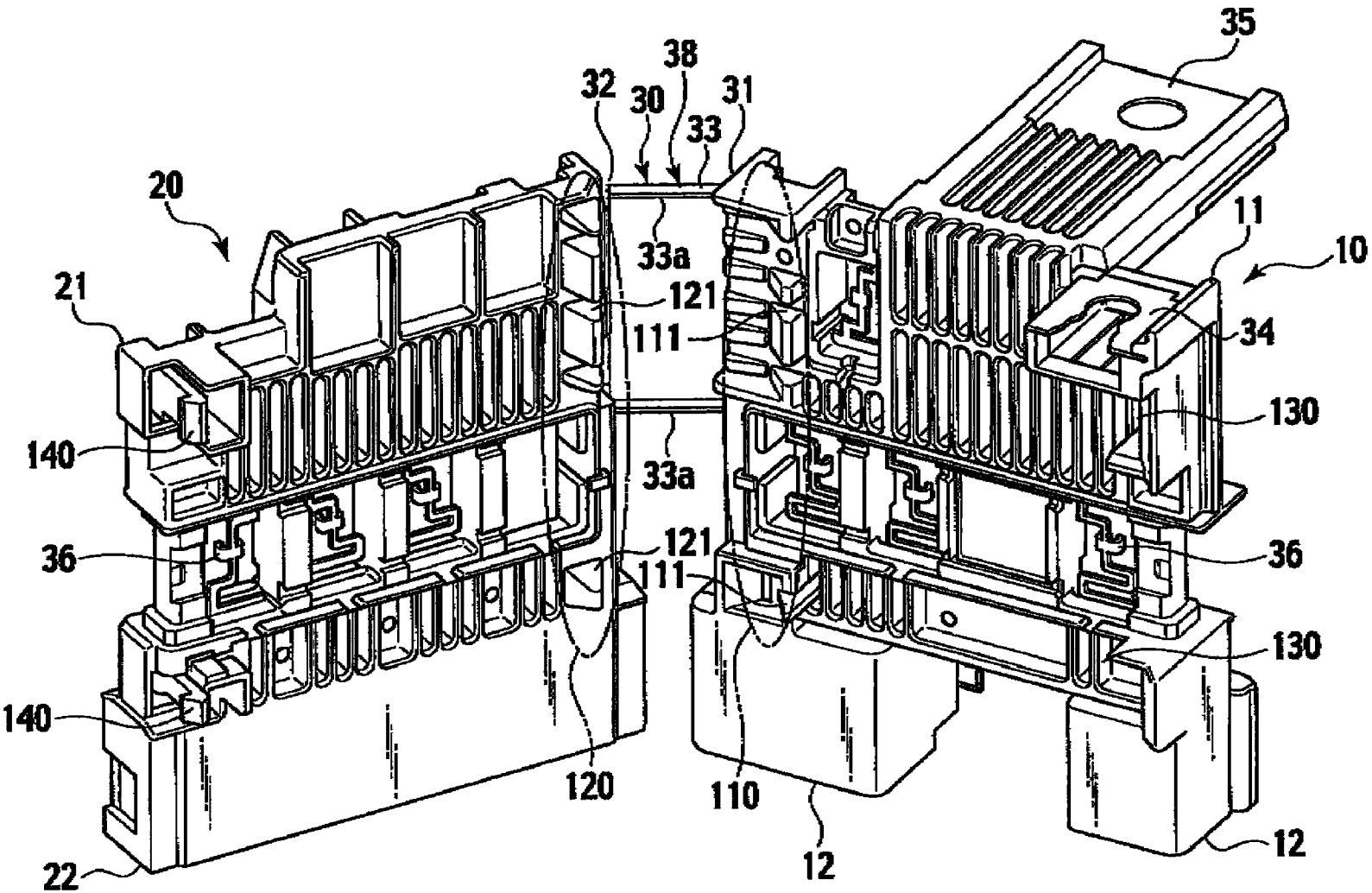
FIG. 2 is a perspective view illustrating a fusible link unit of an embodiment of the present invention which is bent halfway in a bending process.
Figure 3A:
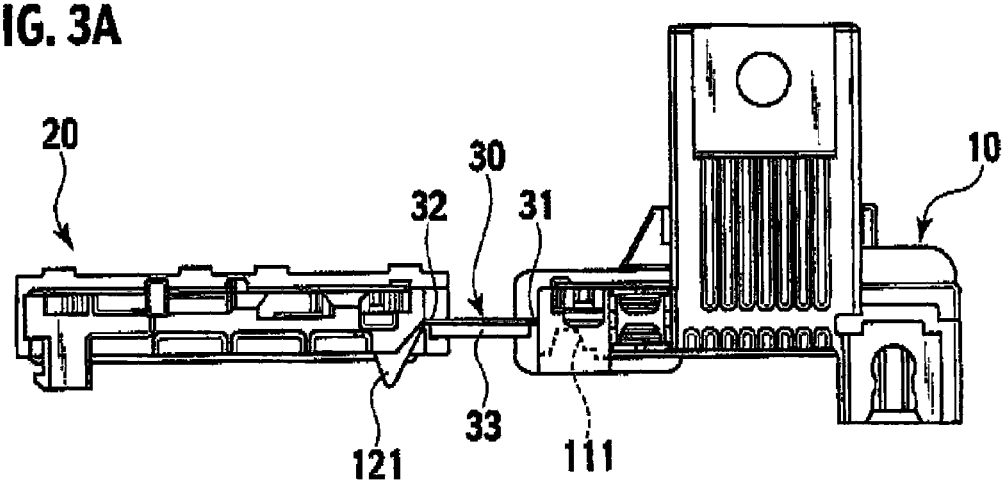
FIGS. 3A to 3C are plan views sequentially illustrating intermediary positions of the fusible link unit between being unbent and being bent during the bending process.
Figure 3B:
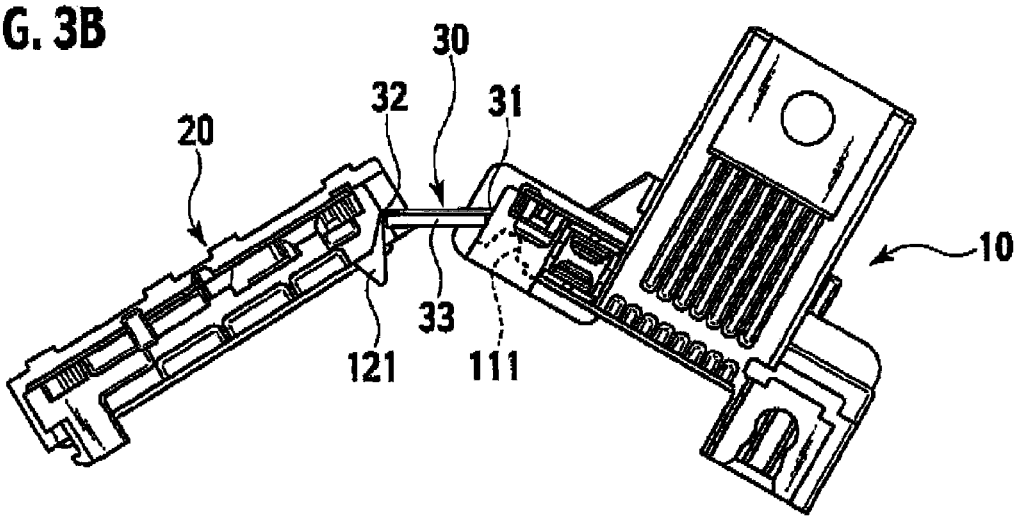
Figure 3C:
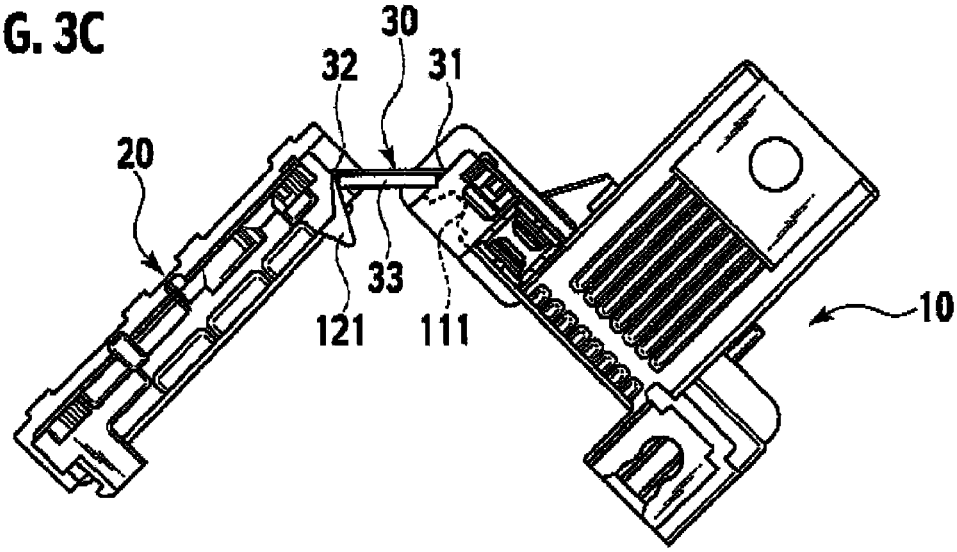
Figure 4D:
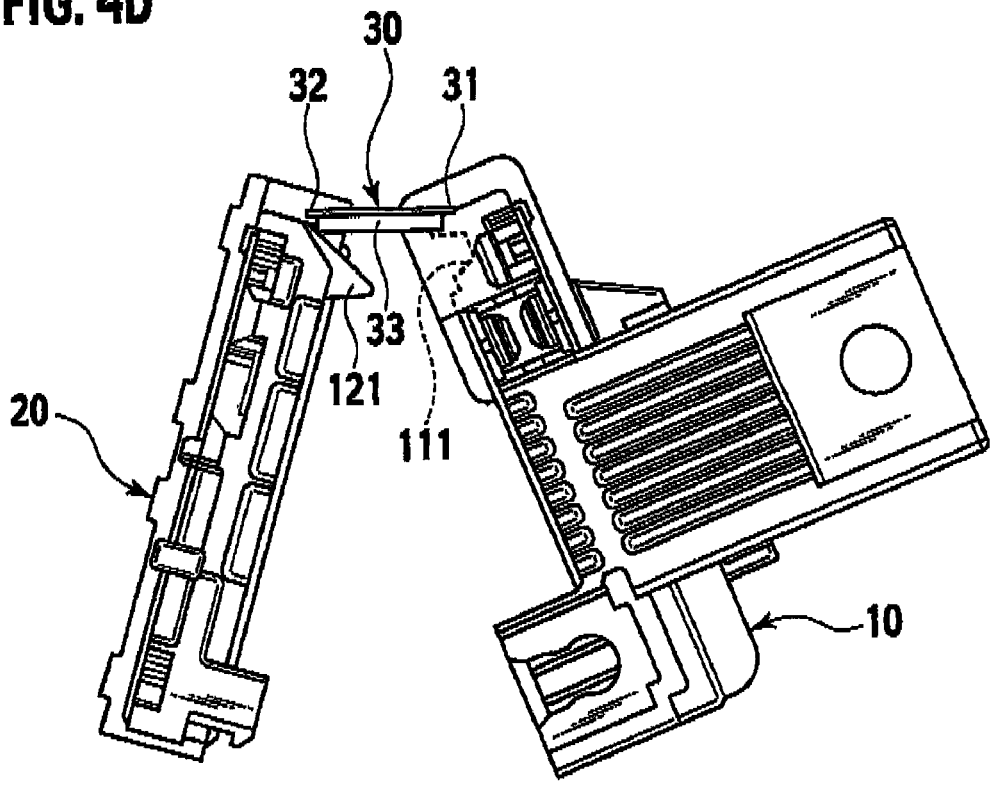
FIGS. 4D to 4E are plan views illustrating intermediary positions of the fusible link unit subsequent to the position shown in FIG. 3C during the bending process.
Figure 4E:
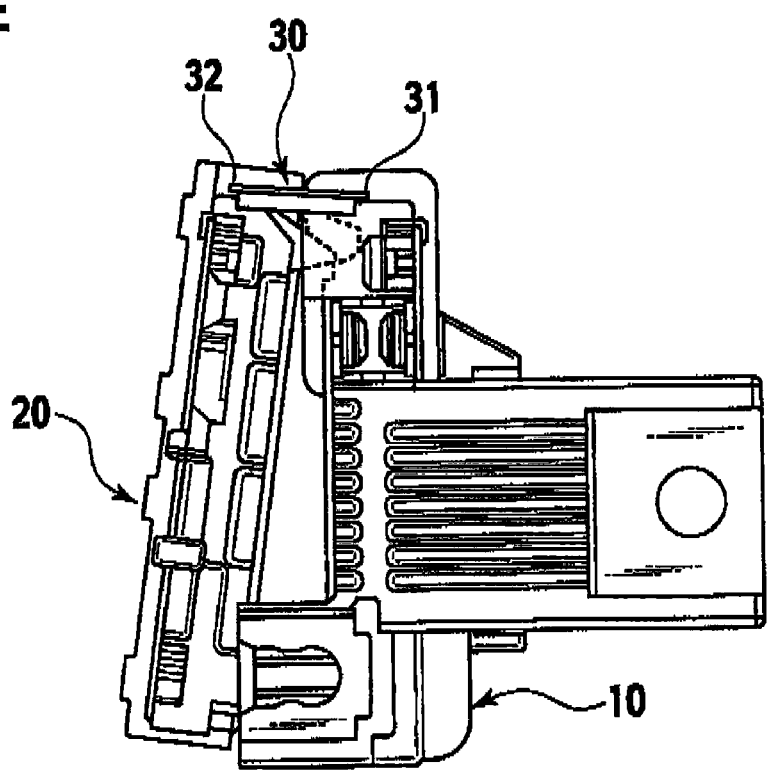
Figure 5:
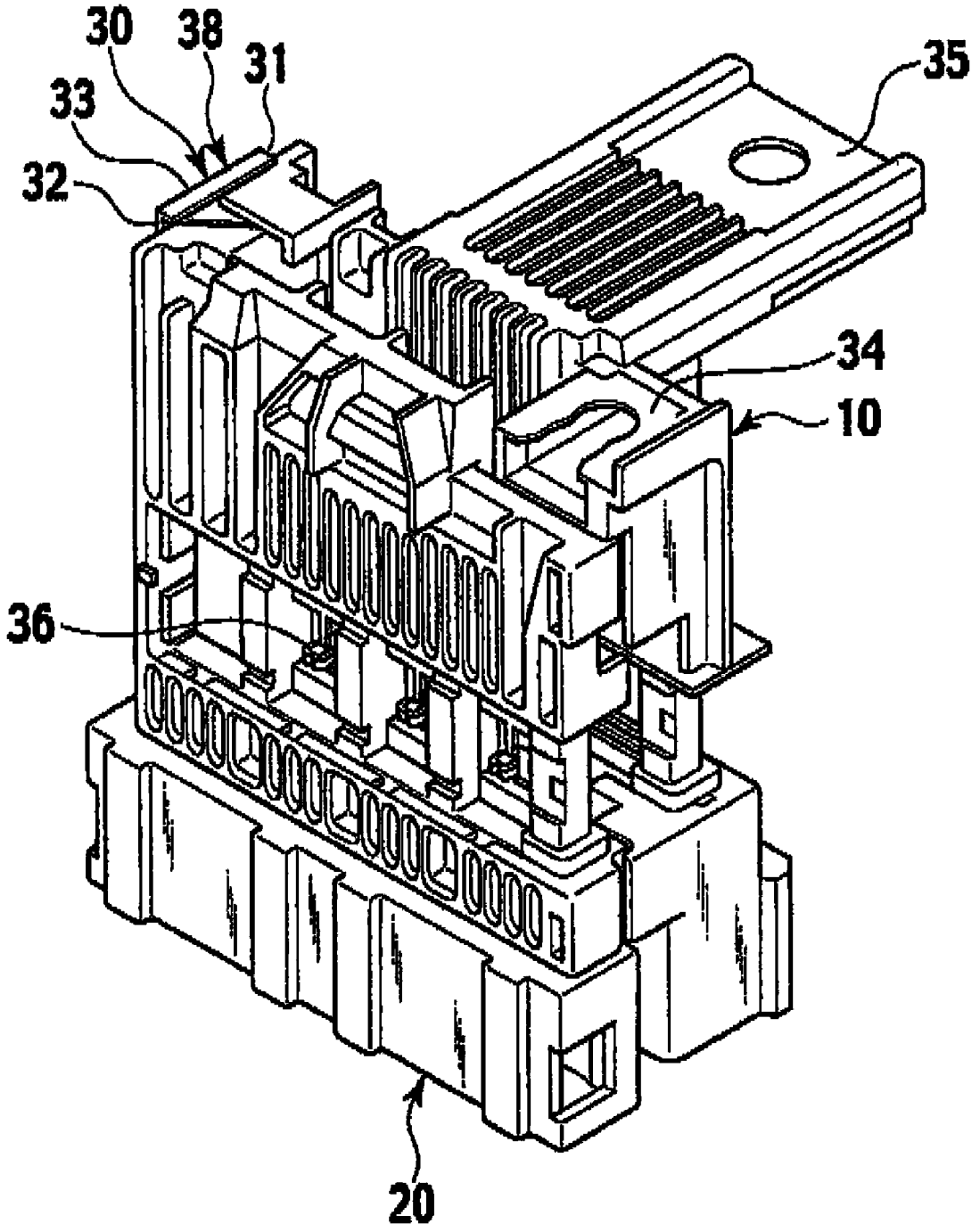
FIG. 5 is a perspective view illustrating the fusible link unit after the bending process is completed.
Figure 6:
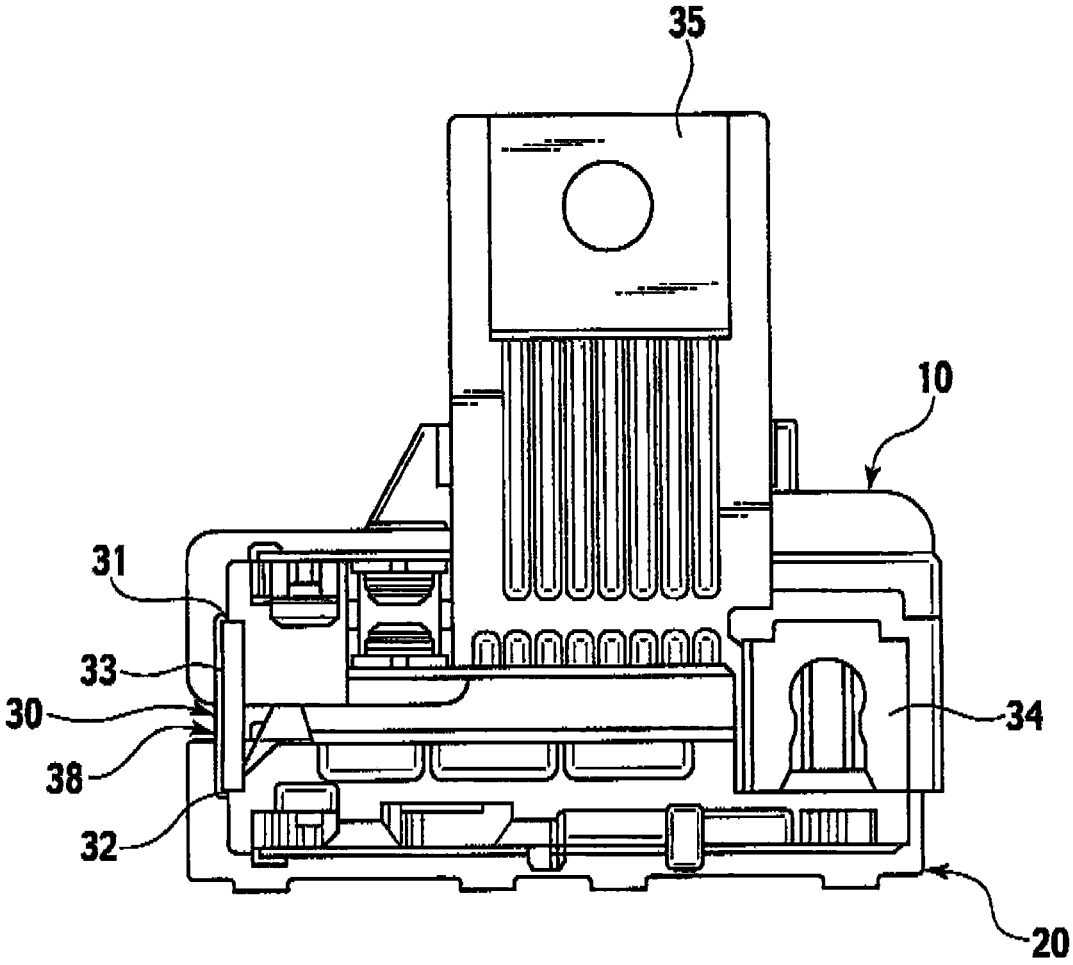
FIG. 6 is a plan view of the same.
Figure 7:
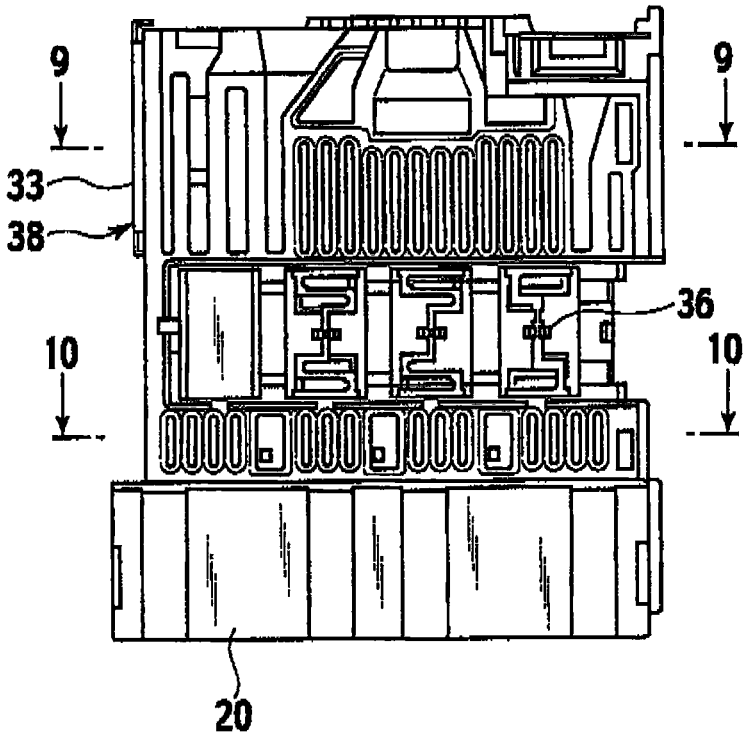
FIG. 7 is a front view of the same.
Figure 8:
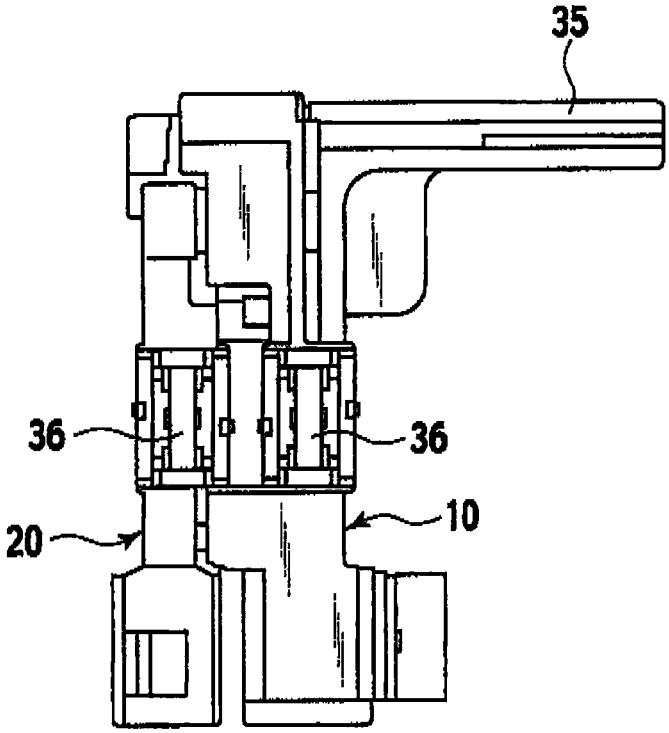
FIG. 8 is a right side view of the same.
Figure 9:
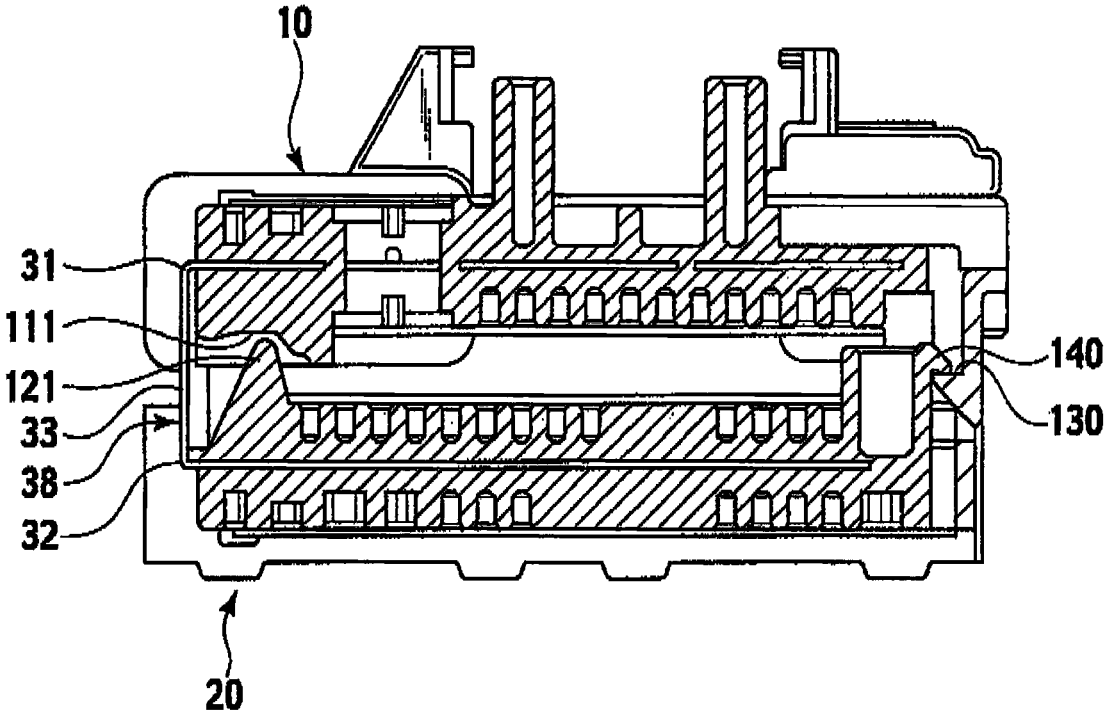
FIG. 9 is a cross-sectional view taken along a line 9-9 of FIG. 7.
Figure 10:
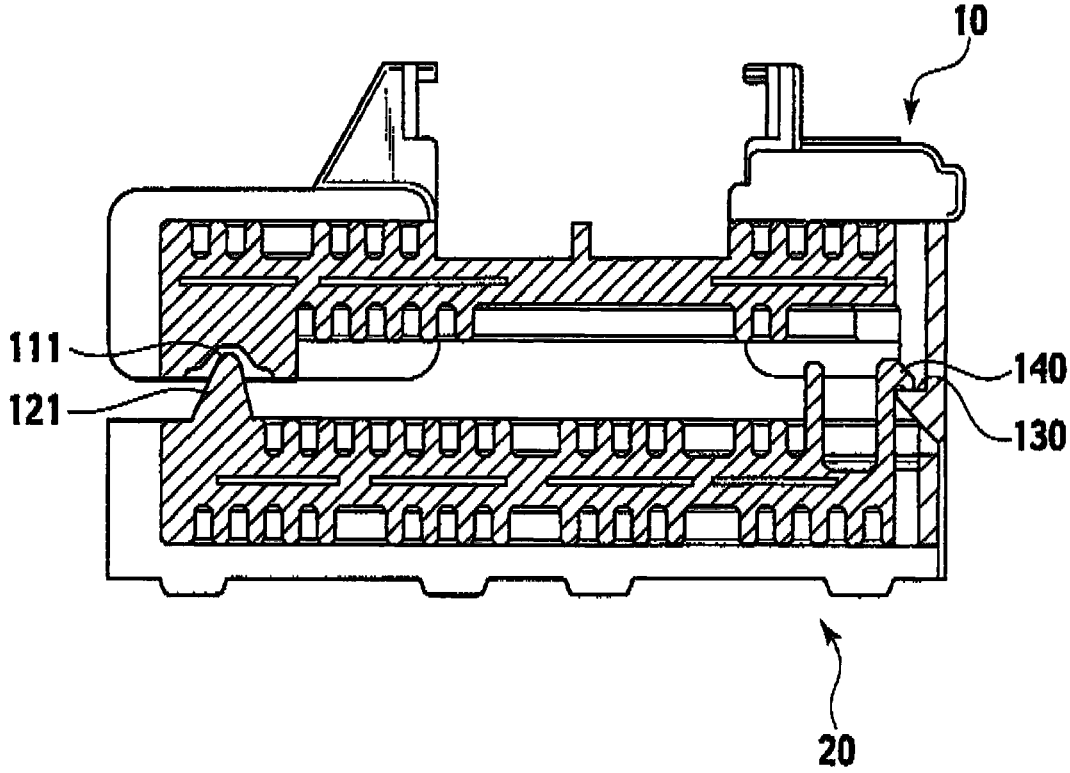
FIG. 10 is a cross-sectional view taken along a line 10-10 of FIG. 7.

Hereinafter, a description is given of an embodiment of the present invention with reference to the drawings.

A fusible link unit shown in FIGS. 2 to 10 includes; a busbar 30; resin housings 11 and 21 assembled to necessary part of the busbar 30 by insert molding; and a resin cover covering exposed part of the busbar 30 (not shown).

The busbar 30 is fabricated by pressing a conductive metal plate. A hinge section 38 including bending sections 31 and 32 at both side edges of a band plate section 33 is provided at the center of the busbar 30. Two fuse circuit constituting plate sections (not shown) are integrally provided on both sides of the hinge section 38 to be linked thereto. These two fuse circuit constituting plate sections are pivoted at the bending sections 31 and 32 in a same direction in a bending process to be placed in parallel at a distance equal to the width of the band plate section 33.

At an upper end of one of the fuse circuit constituting plate sections, a battery terminal connecting section 35 used for direct mount to the battery and an alternator terminal connecting section 34 connected to an alternator are provided by bending rectangular extended pieces in opposite directions. The connecting sections 35 and 34 are provided with a hole or a notch through which a bolt is inserted.

The one of the fuse circuit constituting plate sections includes a plurality of fuse elements 36 and a not-shown load connecting terminal section. Moreover, the other fuse circuit constituting plate section includes fuse elements 36 and a load connecting terminal section.

Upper and lower edges of the rectangular band plate section 33 with a predetermined width are bent in a thickness direction to form flanges 33*a* with a length equal to the overall width of the band plate section 33. The flanges 33*a* at the upper and lower edges are protruded a little but serve as ribs increasing bending rigidity of the band plate section 33.

To the two fuse circuit constituting plate sections on the both sides of the hinge section 38, resin housings 11 and 21 made of insulating resin are assembled by insert molding with necessary part being exposed. The fuse circuit constituting plate sections and resin housings 11 and 21 thus constitute two bodies 10 and 20 constituting fusible links.

At free ends of these bodies 10 and 20, two pairs of engaging sections (engagement units) 140 and engaged sections (engagement units) 130 which are engaged with each other to fix the gap between the free ends are provided. These pairs are provided vertically at intervals.

The two resin housings 11 and 21 face each other when the two bodies 10 and 20 are pivoted. Pairs of recessed guides 111 and projected guide 121 are provided vertically at intervals along the both side edges of the band plate section 33 on the opposed surfaces of the two resin housings 11 and 21 in vicinity areas 110 and 120 of the hinge section 38. These recessed and projected guides 111 and 121 are engaged with each other when the two bodies are pivoted. The two housings 11 and 21 are therefore guided to proper positions.

At lower ends of the resin housings 11 and 21, connector housing sections 12 and 22 are formed, respectively. The load connecting terminal sections are placed within the connector housing sections 12 and 22. A connector capable of detachably fitting to the other connector is thus constituted.

Next, a description is given of an example having a structure developed from the embodiment.

Figure 11:
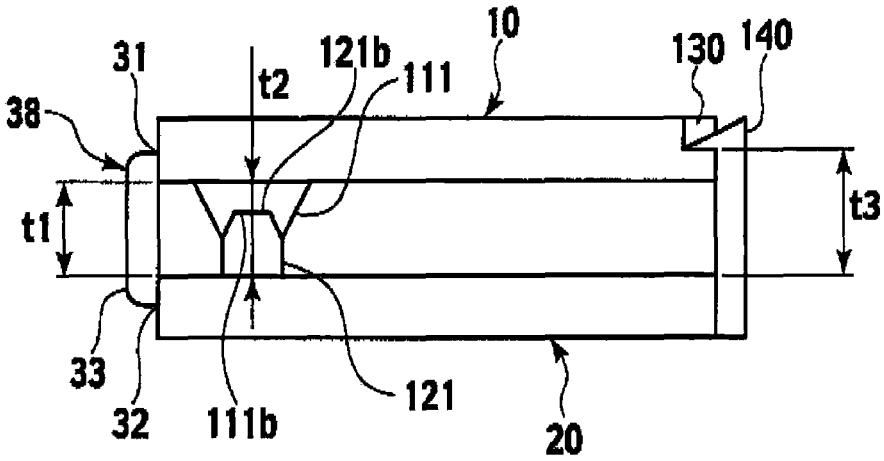
FIG. 11 is a plan view schematically illustrating a relationship between a hinge section, a recessed guide, a projected guide, and engagement units in the fusible link unit of the embodiment.
Figure 13:
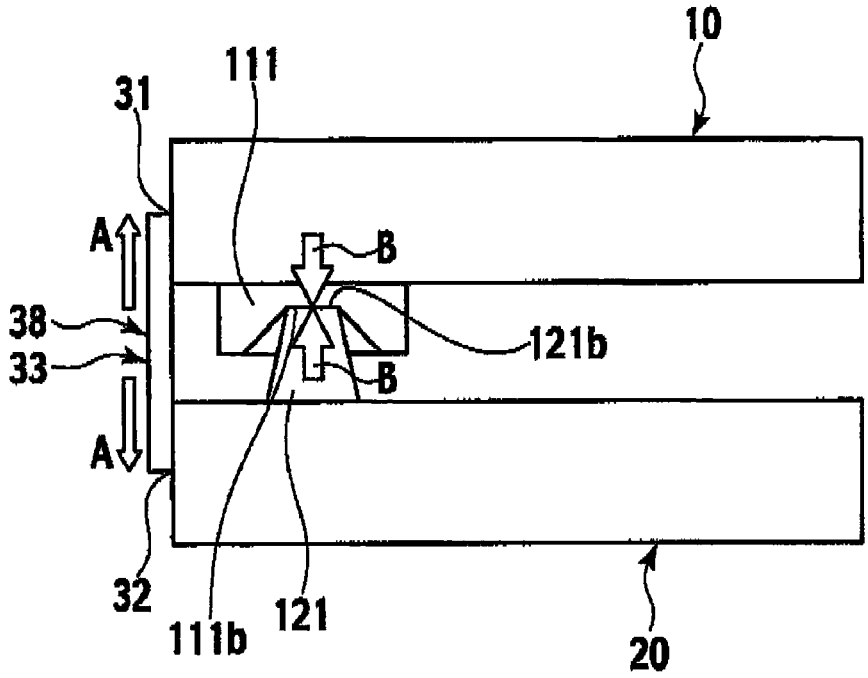
FIG. 13 is a plan view schematically illustrating a force relation when an inner bottom surface of the recessed guide abuts on the top surface of the projected guide in the embodiment.

As shown in FIGS. 11 and 13, inner bottom surface 111*b* and top surface 121*b* are formed in the recessed and projected guides 111 and 121, respectively. These inner bottom surface 111*b* and top surface 121*b* abut on each other when the bending process of the bodies 10 and 20 is completed.

Figure 14:
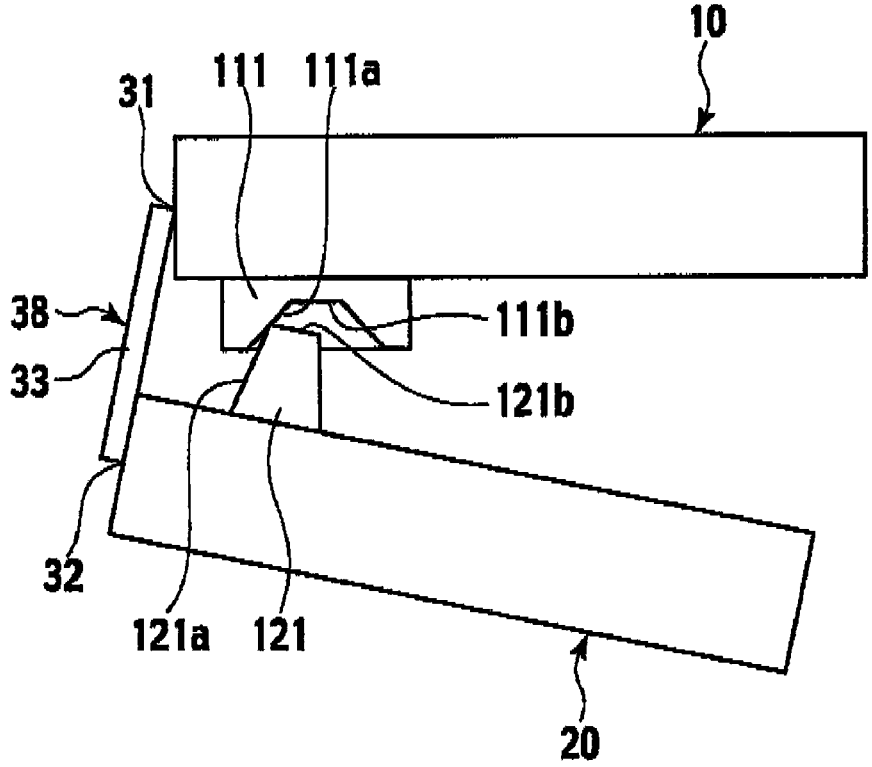
FIG. 14 is a plan view illustrating the tip of the projected guide sliding on a guiding slope of the inner side surface of the recessed guide to provide a guiding operation.

As shown in FIG. 14, guiding slopes 111*a* and 121*a* are provided in an inner side surface of the recessed guide 111 and an outer side surface of the projected guide 121, respectively. The guiding slopes 111*a* and 121*a* come into sliding contact with each other when the recessed and projected guides 111 and 121 start to be engaged with each other and then guide each other to proper positions.

When the recessed and projected guides 111 and 121 are formed so as to have a circular cross section, the guiding slopes 111*a* and 121*a* should be tapered surfaces. Moreover, in the example of the drawing, the guiding slopes 111*a* and 121*a* are provided for both of the inner side surface of the recessed guide 111 and outer side surface of the projected guide 121. However, the guiding slopes only should be at least any one of the inner side surface of the recessed guide 111 and the outer side surface of the projected guide 121.

Next, a description is given of manufacturing of this fusible link unit.

First, the hinge section 38 is arranged substantially in the center of a planar plate material made of metal. The fuse circuit constituting plate sections constituting fuse circuits are provided on the both sides of the hinge section 38 by pressing. The busbar 30 is thus fabricated. Next, the resin housings 11 and 21 are integrally formed with the fuse circuit constituting plate sections on both sides of the hinge section 38 of the busbar 30 by insert molding of synthetic resin. The bodies 10 and 20 are thus formed.

Next, FIGS. 3A to 3C and FIGS. 4D and 4E sequentially illustrate the bending process of the bodies 10 and 20. The both bodies 10 and 20 are pivoted at the bending sections 31 and 32 of the both side edges of the hinge section 38 so as to be in parallel and provide a U-shaped plan view. The engaging and engaged sections 140 and 130 provided at the free ends of the bodies 10 and 20 are locked as shown in FIGS. 5 to 10. The exposed part of the busbar 30 is then covered with a not-shown cover. The fusible link unit is thus completed.

The recessed and projected guides 111 and 121 are provided in the vicinity of the hinge section 38, and the bodies 10 and 20 are pivoted at the bending sections 31 and 32 in the both side edges of the hinge section 38. The bodies 10 and 20 start to be pivoted at the bending sections 31 and 32 and face to each other. In this process, the bodies 10 and 20 are pivoted with the positions thereof being restricted by the guiding operation of the recessed and projected guides 111 and 112.

Accordingly, the bodies 10 and 20 are set at proper positions when the bending is completed without any special awareness of an operator. The engaging portion 140 and engaged portion 130 are reliably engaged with each other. This eliminates variations in positional relationship between the bodies 10 and 20. It is therefore possible to easily fit the fusible link unit to the other connector. This eliminates possibilities of disconnection of the connector due to insufficient wire length of the connector, deformation of the unit due to unnecessary stress applied to the connecting sections, or degradation of water proof or detachment of wires of the other connector.

Moreover, a part of external force is received by the part near the hinge section 38 where the recessed and projected guides 111 and 121 are engaged. This reduces the stress concentration on the hinge section 38. Accordingly, the possibility of damage to the hinge section 38 when external force including vibration acts on the fusible link unit is considerably reduced. The overall strength of the fusible link unit is thus increased, and product strength is less affected by the hinge section 38. Accordingly, the busbar 30 itself can be made thin so that the fusible link unit is available for low current fuses.

Moreover, the pairs of recessed and projected guides 111 and 121 are provided along the bending sections 31 and 32 vertically at intervals. The bodies 10 and 20 are therefore guided to have a predetermined positional relationship as the bending proceeds even if the degree of bending is different between the top and bottom of each of the bending sections 31 and 32. The two bodies 10 and 20 are locked at proper positions.

As shown in FIGS. 11 and 13, the inner bottom surface 111*b* and top surface 121*b* which abut on each other when the two bodies 10 and 20 are completely pivoted to the closed positions are secured in the recessed and projected guides 111 and 121. In this case, the inner bottom surface 111*b* of the recessed guide 111 and the top surface 121*b* of the projected guide 121 abut on each other, respectively. Accordingly, the distance between the two bodies 10 and 20 can be properly set. Moreover, the band plate section 33 of the hinge section 38 is not unnecessarily deformed.

The relative positional relationship between the two engaging portion 140 and engaged portion 130 which lock the two bodies 10 and 20 is set so that the engaging and engaged portions 140 and 130 are unlocked and away from each other when the inner bottom surface 111*b* of the recess guide 111 and the top surface 121*b* of the projected guide 121 abut on each other and are allowed to be engaged with each other by bending the bodies 10 and 20. This can provide an engagement without rattling.

Specifically, t1 (an interval at the hinge section 38) and t2 (an interval at the recessed and projected guides 111 and 121) are set so that an interval on the free end side when the engaging and engagement sections 140 and 130 are not engaged is a little larger than the distance t3 when the engaging and engagement sections 140 and 130 are actually engaged. The engaging and engaged sections 140 and 130 are therefore engaged with each other by causing the inner bottom surface 111*b* of the recessed guide 111 and the top surface 121*b* of the projected guide 121 to abut on each other and then further bending the bodies 10 and 20. Accordingly, it is possible to obtain an engagement without rattling using elasticity of the bodies 10 and 20. This can improve the resistance to vibration of the fusible link unit mounted on a battery and prevent abnormal noise of the same. Moreover, in such a case, dimensional fitting tolerance of the engaging units (engaging and engaged sections 140 and 130) does not need to be strictly set, thus reducing manufacturing cost of a mold.

Figure 12A:
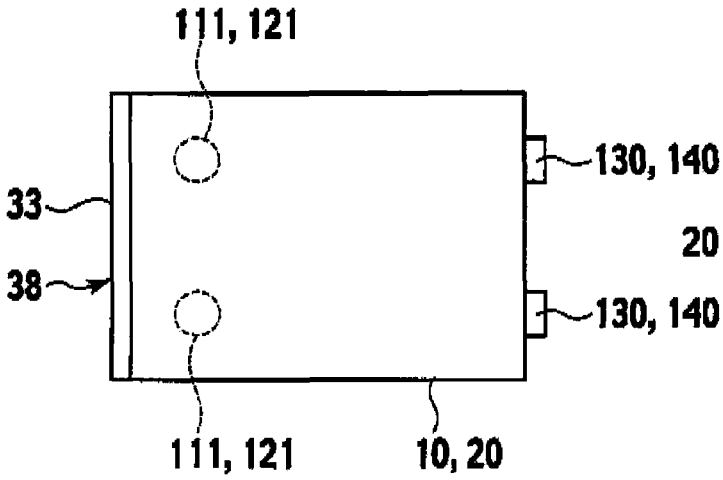
FIGS. 12A and 12B are front and right side views of the same.
Figure 12B:
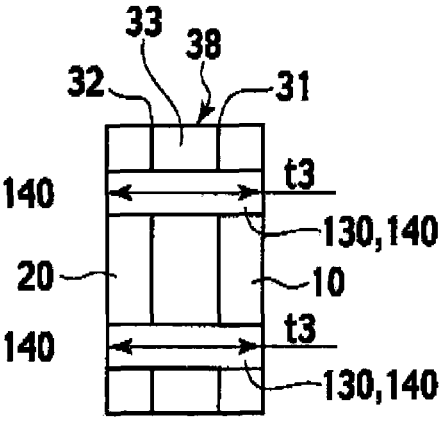

Moreover, the pairs of recessed and projected guides 111 and 121 are arranged along the bending sections 31 and 32 in the vertical direction. In this case, by adjusting the size of the aforementioned interval t2 (the interval at the recessed and projected guides 111 and 121), the interval t3 between the two bodies 10 and 20 at the free ends thereof is properly controlled at each vertical position of the recessed and projected guides 111 and 121 as shown in FIG. 12. This increases workability at engaging the engagement units (engaging and engaged sections 140 and 130).

Furthermore, when the engaging and engaged sections 140 and 130 are engaged with each other, the place where the recessed and projected guides 111 and 121 abut on each other serves as a fulcrum. Accordingly, compression force B is applied to the recessed and projected guides 111 and 121, but tension A is applied to the band plate section 33 of the hinge section 38. This prevents deformation of the band plate section 33.

Moreover, as shown in FIG. 14, the tip of the projected guide 121 and the guiding slope 111*a* of the recessed guide 111 are brought into sliding contact with each other even if the bending angles at the bending sections 31 and 32 vary between the top and bottom of the two bodies. This allows the bending positions of the bodies to be corrected. The bodies 10 and 20 can be therefore eventually guided to the proper positions, and the engagement units (the engaging and engaged sections 140 and 130) can be appropriately aligned. The two bodies 10 and 20 are then properly locked.

In the case of mounting the fusible link unit onto the battery, first, the battery connecting portion 35 is connected to a starter cable terminal (not shown) and a battery connecting terminal (not shown). The battery connecting terminal is coupled to an electrode post (not shown) of the battery. The fusible link unit is thus directly mounted on the battery. The alternator terminal connecting section 34 is connected to an alternator terminal (not shown). Furthermore, the connectors (the part of the connector housing sections 12 and 22) are connected to the other connector (not shown), thus completing wiring.

Through such connection, power from the battery or alternator is distributed to each load through fuse circuits of each fuse circuit constituting plate section. When the battery becomes low, the battery is supplied with power from the alternator and is charged. When a predetermined amount of current or more flows through any one of the fuse elements 36 because of a short-circuit accident or the like, the fuse element 36 is heated and fused, thus preventing an accident due to excess current.

What is claimed is:

1. A fusible link unit, comprising:

a busbar;

a hinge section provided in center of the busbar and including bending sections at both side edges of a band plate section; and two bodies constituting fusible links, which are integrally provided on both sides of the hinge section to be linked to two fuse circuit constituting plate sections and formed by assembling two resin housings composed of insulating resin by insert molding to the respective fuse circuit constituting plate sections with necessary part being exposed, the two bodies being arranged in parallel at a distance equal to width of the band plate after being pivoted at the bending sections in a same direction, wherein the two bodies are pivoted in the same direction at the bending sections into a U shape in a plan view during a bending process, the U shape in the plan view is maintained by engagement units which are individually provided for the resin housings at positions distant from the hinge section, and at least a pair of recessed and projected guides is provided in vicinity of the hinge section in opposed surfaces of the two resin housings, the recessed and projected guides are opposed to each other when the two bodies are pivoted and are engaged with each other when the two bodies are pivoted to guide the two resin housings to proper positions.

2. The fusible link unit according to claim 1, wherein a plurality of the pairs of recessed and projected guides are provided, the pairs of recessed and projected guides are arranged along both side edges of the band plate section at intervals.

3. The fusible link unit according to claim 1, wherein the recessed and projected guides respectively include an inner bottom surface and a top surface which abut on each other when the bending process of the two bodies is completed.

4. The fusible link unit according to claim 3, further comprising:

engagement units locking the two bodies, wherein the engagement units are not engaged and distant from each other when the inner bottom surface of the recessed guide and the top surface of the projected guide abut on each other and are engaged with each other when the bodies are bent.

5. The fusible link unit according to claim 1, further comprising:

a guiding slope in at least one of an inner side surface of the recessed guide or an outer side surface of the projected guide, wherein the guiding slope is brought into sliding contact with the recessed or projected guide when the recessed and projected guides start to be engaged with each other and then guides the same to a proper position.

* * * * *